United States Patent [19]

Langfield

[11] 4,168,862

[45] Sep. 25, 1979

[54] WEAR OR THRUST PLATES FOR HYDRAULIC ROCK SPLITTING APPARATUS

[76] Inventor: Edward R. Langfield, 140 Elmwood Ave., Glen Rock, N.J. 07452

[21] Appl. No.: 867,026

[22] Filed: Jan. 5, 1978

[51] Int. Cl.[2] ..... E21C 37/04

[52] U.S. Cl. ..... 299/23; 299/20; 308/239

[58] Field of Search ..... 299/22, 23; 308/239, 308/244; 403/272

[56] References Cited

U.S. PATENT DOCUMENTS

| | | | |
|---|---|---|---|
| 1,679,772 | 8/1928 | Johnson | 308/239 |
| 1,718,229 | 6/1929 | Graham | 308/239 X |
| 2,473,307 | 6/1949 | Seipt et al. | 308/244 |
| 2,542,405 | 2/1951 | Fink | 308/244 |
| 3,762,881 | 10/1973 | Dunn | 308/239 X |
| 3,957,309 | 5/1976 | Darda | 299/22 |
| 4,073,427 | 2/1978 | Keifert et al. | 403/272 X |

*Primary Examiner*—Ernest R. Purser
*Assistant Examiner*—Nick A. Nichols, Jr.
*Attorney, Agent, or Firm*—Ralph R. Roberts

[57] ABSTRACT

This invention pertains to hydraulically actuated rock splitters which utilize a wedge and feather action. The forward movement of this wedge places a corresponding thrust load on the feathers and their retaining means. Conventionally, the feathers have enlarged portions which are engaged by and are retained by hardened steel thrust or wear plates carried by a shell or housing. As a means of keeping the weight within reasonable limits this housing is usually made of aluminum or an alloy of aluminum. The support for these hardened steel plates, as provided by the housing, is usually insufficient resulting in a cracking or breaking of the hardened steel plates. A lamination of these plates and providing a softer steel backing reduces or eliminates damage to the housing when cracking of the hardened steel plates occurs.

7 Claims, 10 Drawing Figures

WEAR OR THRUST PLATES FOR HYDRAULIC ROCK SPLITTING APPARATUS

BACKGROUND OF THE INVENTION

1. Field of the Invention

With reference to the classification of art as established in and by the U.S. Patent and Trademark Office, the present invention is believed to be found in the general Class entitled, "Mining or in Situ Disintegration of Hard Material" (Class 229) and in the subclass entitled, "expansible breaking down devices - piston" (subclass 22) and the subclass using a "wedge" (subclass 23).

2. Description of the Prior Art

The use of a wedge and associated feathers for splitting rock is shown particularly in U.S. Pat. No. 3,957,309 to DARDA as issued on May 18, 1976 and in the application Ser. No. 795,074 filed May 9, 1977 to LANGFIELD, et al. These references are applicable to a hydraulically actuated rock splitter in which a tapered wedge is moved between opposed and contiguous feathers. Conventionally, the upper ends of these feathers are retained by housings of metal. On the thrust and splitting movement or action of the wedge there is a thrust load on the enlarged retaining ends of the feathers. This thrust load is conventionally transmitted by and through hardened steel plates to a housing retainer.

As reduced to practice, this hardened steel thrust or wear plate often cracks or breaks during or as a result of the thrust and splitting action movement of the tapered wedge. These wear or thrust plates are retained by grooves and/or screws. Under this thrust and when and where dirt, a rock or other material or factor reduce the ability of the wedge to slide along the face of the feathers an increase of pressure and a cracking or breaking of these plates results. Repeated actuation of the wedge to produce a splitting action often causes the cracked or broken wear or thrust plates to cut or mutiliate the housing or retainer, usually made of aluminum, to the extent that it is not satisfactorily useable.

In particular the housing or retainer used in the DARDA apparatus and as shown in the LANGFIELD application, above identified, utilizes an aluminum alloy. The wear or thrust plates are hardened steel and when broken or cracked the sharp edges cut or gouge portions of the retainer. Repeated use of the tool often causes the area of the housing retaining these broken plates to become cut or worn beyond acceptable limits. The present invention provides an additional thrust plate of soft steel which may be bonded to the hardened steel plate by epoxy cement, silver soldering or brazing. In certain installations or applications the soft metal plate may be held in place by a bolt or screw and the hardened steel plate placed next to the softer steel plate. This results in the hardened steel plate being positioned between the soft steel plate and the enlarged end portions of the feathers.

When damage to the housing occurs from the cracking, and further disintegration of the broken thrust plates takes place because of continued use of the rock splitter, repair of the housing is required. This rework of the housing occurs at the recess where the thrust plate is originally mounted. This rework consists of remachining of this recess to accommodate the additional thrust plate of softer steel. If the damage to the housing is extensive, a cutting away of the damaged portion may weaken the housing to a degree that is unsatisfactory. The housing then must be discarded or a rebuilding of the damaged area may be accomplished by welding and remachining.

The softer steel support plate is preferably made as one-quarter, five-sixteenths, three-eighths or sometimes as much as seven-sixteenths inch in thickness. This does not preclude a thickness of up to three-quarters of an inch which has proved satisfactory. The same contour on the outside as the hardened thrust plate is usually carried forth in the softer steel reinforcing support plate, to be hereinafter more fully described.

SUMMARY OF THE INVENTION

This invention may be summarized at least in part with reference to its objects.

It is an object of this invention to provide and it does provide, a separate reinforcing thrust plate which in combination with the hardened steel plate provides a capacity to withstand the thrust imparted to the wedge of the splitter.

It is a further object of this invention to provide, and it does provide, a reinforcing thrust plate which is combined with a conventional hardened steel thrust plate to provide a combined thrust plate which is fitted into a housing having a receiving recess which is enlarged to receive and retain this reinforced thrust plate.

In brief, this invention is directed to and toward the problem of cracking, breaking and the subsequent destroying of the seat in the housing by the broken hardened steel plate. A cutting of a deeper seating groove in the housing permits the use of a reinforced plate employing a second thrust plate of a much softer steel. This reinforced plate where and when initially employed in a housing allows or permits the hardened plate to crack and break without damage to the aluminum housing. The housing assembly, worth several hundred dollars, may be saved through rework of the housing. This rework may cost as little as a hundred dollars or so. The new thrust plate assemblies are little more expensive than a single thickness hardened steel plate.

In addition to the above summary the following disclosure is detailed to insure adequacy and aid in understanding of the invention. This disclosure, however, is not intended to prejudice that purpose of a patent which is to cover each new inventive concept therein no matter how it may later be disguised by variations in form or additions of further improvements. For this reason there has been chosen embodiments of the improved thrust plates for hydraulic rock splitting apparatus as adopted for use in the lower housings of such apparatus and showing a preferred means for making a laminate structure. These specific embodiments have been chosen for the purpose of illustration and description as shown in the accompanying drawings wherein:

BRIEF DESCRIPTION OF THE DRAWINGS

In the following description and in the claims various details are identified by specific names for convenience. These names, however, are intended to be generic in their application. Corresponding reference characters refer to like members throughout the several figures of the drawings.

The drawings accompanying this specification disclose certain details of construction for the purpose of explanation but it should be understood that structural details may be modified in various respects without departure from the concept of the invention and that the invention may be incorporated in other structural forms than shown.

EMBODIMENTS OF FIGS. 1, 2 AND 3

Figure 1:
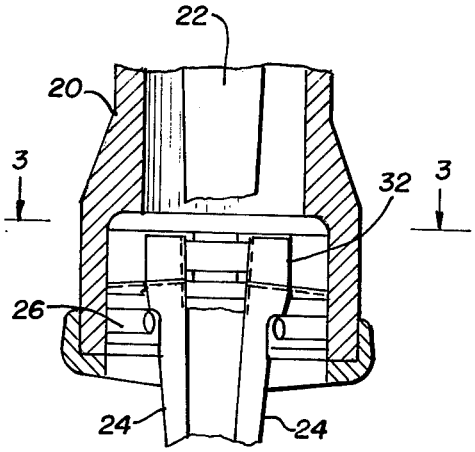
FIG. 1 PRIOR ART
FIG. 1 represents a fragmentary portion of the side view of the apparatus shown in U.S. Pat. No. 3,957,309 and its FIG. 5.
Figure 2:
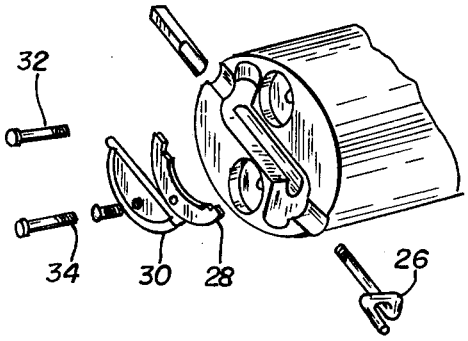
FIG. 2 PRIOR ART
FIG. 2 represents a fragmentary exploded isometric view of a DARDA model 8 rock splitter and showing the wear or thrust plate as provided in the reference DARDA patent.
Figure 3:
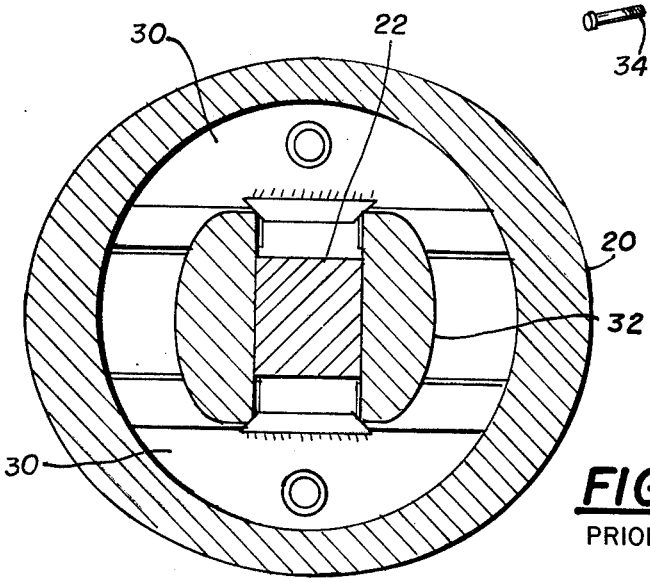
FIG. 3 PRIOR ART
FIG. 3 represents the plan view of the apparatus of U.S. Pat. No. 3,957,309 as seen in its FIG. 6.

Referring now to the drawings and in particular to FIGS. 1, 2 and 3 which correspond at least in part to the showing and description of the DARDA apparatus as shown in U.S. Pat. No. 3,957,309 as issued on May 18, 1976. In the drawings this has been identified as prior art. In a housing 20 is moved slider wedge 22 by a hydraulic cylinder, not shown. A like pair of feathers 24 is retained in formed grooves and passageways in the housing 20 by key pieces 26. Upper and lower thrust or wear plates 28 and 30 enclose ends of the feathers 24. The lower thrust plates in this DARDA patent are shaped on their feather supporting surface (upper) to maintain the ear portions in a determined spaced relationship. Cap screws 34 and 32 retain these thrust plates in position.

In the course of use and since the lower thrust plate is of a hardened steel, usually above Rockwell "C" 65, with high pressure these plates often crack. After the initial failure of these lower thrust plates 30, repeated splitting motions of the slider wedge 22 tends to cause the plates to further break and these pieces tend to cut or chew the seat formed in the housing usually alloy aluminum. A chewing of this seat by the broken thrust plate results in a deterioration of the holding alignment of the housing and the feathers held thereby. The upper thrust plate 28 does not have applied thereto the heavier or concentrated loads as does the lower thrust plate 30. It is these high pressure loads on the lower thrust plate 30 which occur when the tool is tilted, twisted or grit enters the space between the slider wedge and feathers that cause the lower plates to fracture.

EMBODIMENT OF FIG. 4

Figure 4:
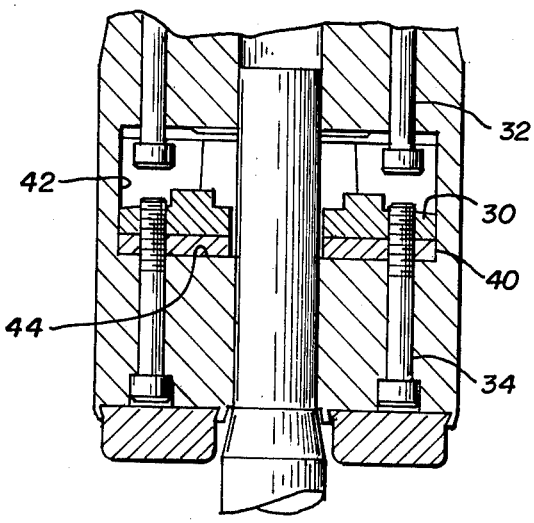
FIG. 4 represents a sectional side view of a DARDA rock splitting apparatus as modified for and showing a thrust plate assembly wherein an additional softer metal thrust plate is mounted between the hardened plate and the modified housing.

In FIG. 4 is shown a modification of the DARDA splitter in which a cap screw 34 retains not only the lower thrust plate 30 but also an added softer reinforcing thrust plate 40. Thrust plate 40 is made of a softer steel and this softer plate is preferably of a Rockwell "C" in the mid thirties. This additional thrust plate is much softer than the thrust plate 30 normally provided usually above 60 Rockwell "C." The recess 42 is remachined toward the outer end to provide a support shoulder 44 which provides a new seating surface that accommodates the additional thickness of the added support thrust plate 40. It is contemplated that in many instances the support plate 40 and the hardened thrust plate 30 may be fastened together as by means of silver solder, brazing or epoxy cement which provides a bond or adhesive to secure the two plates in contiguous relationship one with the other during particularly the forward motion of the slider wedge. This bonded relationship prevents damage if and when the support plate 30 cracks or fractures under excessive load. As reduced to practice, it has been found that a fracture of the plate 30 with and when a softer steel thrust plate 40 has been placed in position does not destroy the shoulder 44. The soft thrust plate accommodates the abrasive and cutting action of the fractured wear plate so that damage of the shoulder 44 and the housing 20 does not occur when this softer thrust plate is between shoulder 44 and plate 30.

EMBODIMENTS OF FIGS. 5 AND 6

Figure 5:
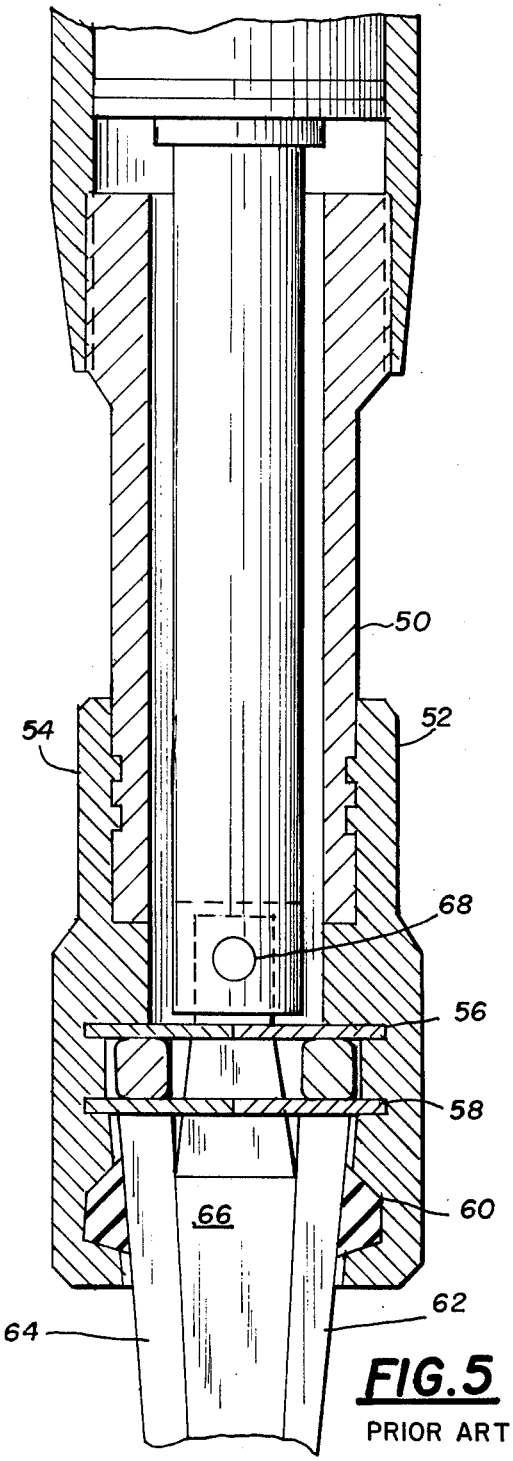
FIG. 5 PRIOR ART
FIG. 5 represents a fragmentary, sectional side view of the rock splitting apparatus as shown in FIG. 5*a* in my application, Ser. No. 795,074.
Figure 6:
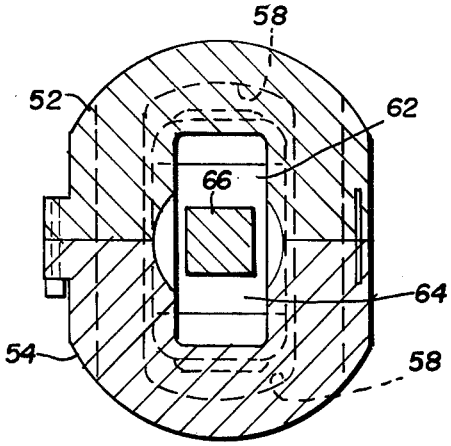
FIG. 6 PRIOR ART
FIG. 6 represents a side view of the apparatus as seen in FIG. 5*b* in my reference application.

In FIG. 5 (labelled prior art) is shown an embodiment in which a split clamp shell, as seen in my application Ser. No. 795,024, filed May 9, 1977, is provided on the lower end of the thrust barrel. In particular a barrel extension 50 has grooves formed on its lower end to receive clamp shell halves 52 and 54. These halves retain upper' and lower thrust plates 56 and 58 in complementary formed grooves. A rubber collar 60 urges feathers 62 and 64 toward the slider wedge 66. As seen particularly in FIG. 6, the upper and lower thrust plates 56 and 58 are horseshoe in shape with a relief to accommodate the outward movement of the feathers and also to provide a seating shoulder for the feathers. The parting line of thrust plate 56 and 58 is on the center line and plane which passes through the axis of the pivot point 68 of the slider wedge 66. This is 90 degrees from the parting line of the thrust plates as provided by and for the DARDA splitter.

EMBODIMENT OF FIG. 7

Figure 8:
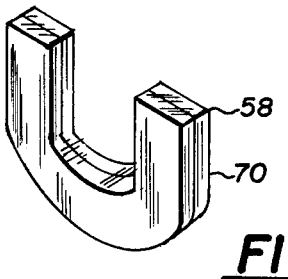
FIG. 8 represents an exploded isometric view of the wear or thrust plate as constructed with an additional support plate of softer metal and used with the modified apparatus of FIG. 5.
Figure 7:
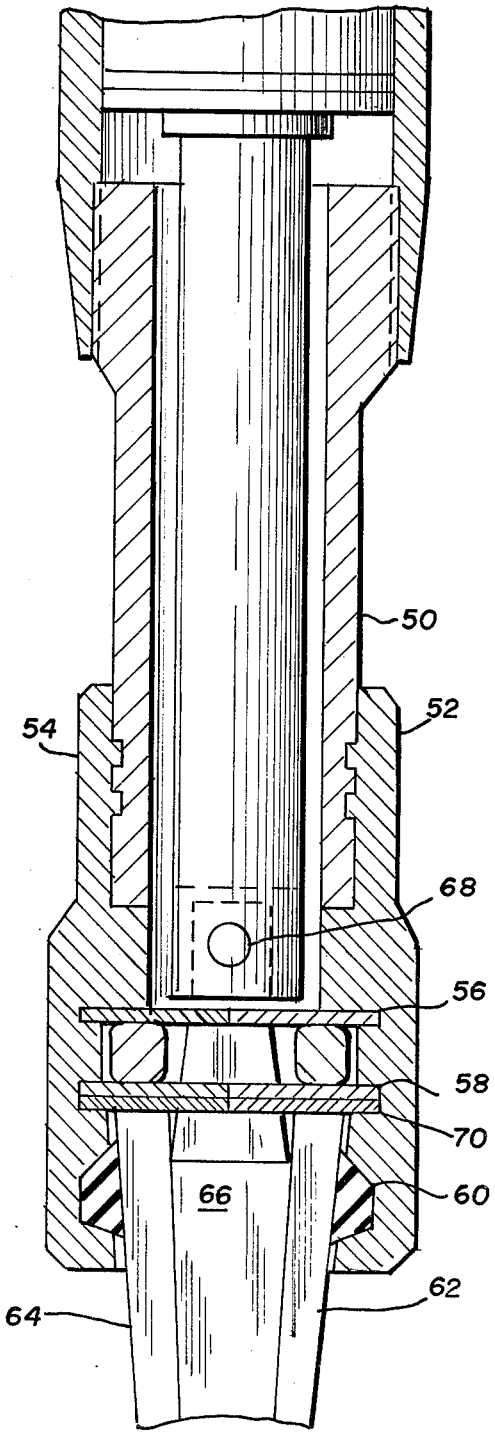
FIG. 7 represents a plan view of the apparatus as seen in FIG. 5*b* in my reference application modified to accept the new reinforced thrust plate.

In FIG. 7 is shown the modification to the clamp shells 52 and 54 in which the groove for the hardened thrust plate 58 is widened to accept the softer additional reinforcing thrust plates 70 and 72. These additional thrust plates, are below the hardened plates 58 and in the case of the reinforcing plates for the DARDA splitter, are made of a softer steel preferably in the mid thirties Rockwell "C." Preferably the lower plate 70 is adhered to the hardened thrust plate 58 by means of epoxy cement, silver solder or brazing. This laminate is seen in FIG. 8 and the means of attaching the softer plate 70 to the hardened plate 58 is merely a matter of preference.

Figure 9:
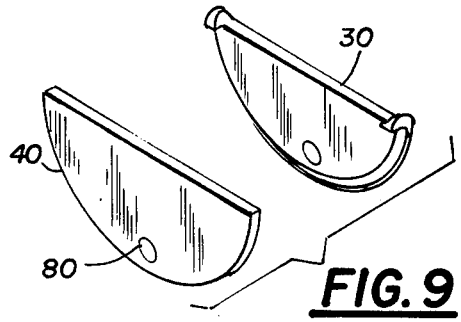
FIG. 9 represents an exploded isometric view of the DARDA thrust or wear plate and with a softer support plate.
Figure 10:
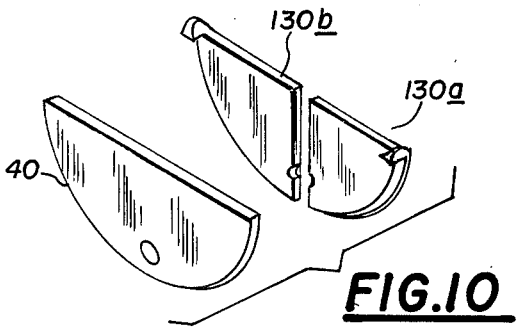
FIG. 10 represents an exploded isometric view of the thrust plate of FIG. 9 as cut in two and mounted on and to the softer metal support plate.

EMBODIMENT OF FIGS. 9 and 10

In FIG. 9 is shown the lower thrust plate 30 and the softer steel reinforcing plate 40 in which the outside contours are matching. A thread is formed in aperture 80 so that the lower plate may at least be secured in the housing 20.

In FIG. 10 is shown a modification of the lower plate 30 indicated as 130. Upper member 30 is cut by an abrasive cutter into two pieces forming pieces 130*a* and 130*b*. These halves are secured to the softer reinforcing plate 40 by means of epoxy cement, silver solder or brazing, above noted.

It is to be noted that providing a reinforcing plate of softer steel which is shown in FIGS. 8, 9 and 10 requires a remachining or accommodating in the groove in the housing or clamp shell housing. The grooves which retain the lower thrust plate are widened to accommodate this additional thickness. This additional lower thrust plate as it provides the reinforcing preferably is a minimum of one-quarter inch thick and often times is as much as three-eighths inch thick. Whatever the thickness the groove is made additionally wider in order to accommodate this additional thrust plate of softer steel. This softer steel plate accepts the thrust of the slider wedge against the feathers. Any disintegration of the hardened steel thrust plates is absorbed or buffered by the presence of this softer steel thrust plate. The softer steel thrust plate is usually rendered useless after a brief disintegration of the hardened thrust plate. The lower thrust plate assembly is replaced after a brief period of use and a cracking of the hardened thrust plate. A replacement of the thrust plate assembly is much more economical than a replacement of the thrust plates and housing.

Terms such as "left," "right," "up," "down," "bottom," "top," "front," "back," "in," "out" and the like are applicable to the embodiments shown and described in conjunction with the drawings. These terms are merely for the purposes of description and do not necessarily apply to the position in which the rock splitter and the dual hardness thrust plates may be constructed or used.

While particular embodiments of the thrust plate reinforcement have been shown and described it is to be understood the invention is not limited thereto since modifications may be made within the scope of the accompanying claims and protection is sought to the broadest extent the prior art allows.

What is claimed is:

1. An improved lower thrust plate means for assembly in hydraulically actuated rock splitters which utilizes a wedge and feathers for the splitting of a predrilled rock, the feathers having enlarged end portions which rest on appropriately positioned thrust plates as the tapered wedge is moved to cause the feathers to move apart, this improved lower thrust plate means in combination with a correspondingly formed receiving and retaining housing including: (a) a pair of conventionally formed and sized thrust plates of hardened steel; (b) a pair of thrust plates of softer steel of substantially planar configuration and of a given thickness such as one-quarter inch and placed in a contiguous and aligned relationship with the hardened plates positioned above the softer steel thrust plates; (c) a corresponding retaining groove formed in the housing and having a width which accommodates both the conventional hardened steel and the softer steel contiguously aligned thrust plates arranged in tandum, and (d) means for retaining the hardened and softer steel lower thrust plates in alignment and in a contiguous relationship as the wedge is moved to cause the free portion of the feathers to be moved outwardly.

2. An improved thrust plate means as in claim 1 in which the softer steel thrust plates have a circular outer configuration and a thickness of not less than one-quarter inch and more than three-quarter inch.

3. An improved thrust plate means as in claim 1 in which the softer steel thrust plates have a horseshoe-shaped configuration and a thickness of not less than one-quarter inch and more than three-quarter inch.

4. An improved thrust plate means as in claim 1 in which the hardened steel and softer steel thrust plates are maintained in a contiguous relationship by silver soldering at their facing surfaces.

5. An improved thrust plate means as in claim 1 in which the hardened steel and softer steel thrust plates are maintained in a contiguous relationship by brazing at their facing surfaces.

6. An improved thrust plate means as in claim 1 in which the hardened steel and softer steel thrust plates are maintained in a contiguous relationship by an application of epoxy adhesive at their facing surfaces.

7. An improved thrust plate means as in claim 1 in which the softer steel thrust plates are held in position by screws which enter and engage threaded apertures formed in this plate.

* * * * *